United States Patent [19]

Waters, Jr.

[11] Patent Number: 4,620,691

[45] Date of Patent: Nov. 4, 1986

[54] BOARD STRAIGHTENING DEVICE

[76] Inventor: Lloyd E. Waters, Jr., 951 Rogue River Ave., Grants Pass, Oreg. 97527

[21] Appl. No.: 734,913

[22] Filed: May 16, 1985

[51] Int. Cl.[4] ..... A47G 27/04

[52] U.S. Cl. ..... 254/16

[58] Field of Search ..... 254/11, 15–17, 254/113, 119, 129–131, 208–212

[56] References Cited

U.S. PATENT DOCUMENTS

| | | | |
|---|---|---|---|
| 299,220 | 5/1884 | Match | 254/16 |
| 343,412 | 6/1886 | Willix | 254/211 |
| 376,439 | 1/1888 | Holmes | 254/16 |
| 559,052 | 4/1896 | Bennett | 254/16 |
| 1,568,885 | 1/1926 | Derby | 254/15 |
| 1,766,423 | 6/1930 | Bartlow | 254/212 |
| 1,918,017 | 7/1933 | Christ | 254/16 |
| 2,717,144 | 9/1955 | Labuza | 254/16 |
| 4,230,302 | 10/1980 | Crain | 254/212 |

*Primary Examiner*—Robert C. Watson

*Attorney, Agent, or Firm*—John F. Ingman

[57] ABSTRACT

A board straightening device which embodies levers to expand a concentric piping arrangement, one end of which is fixed on a joist, rafter stud, or other board supporting member, and the other end is placed against a crooked board, such as decking or siding, which is being nailed across the board supporting member. The device includes a cleated foot for gripping the board supporting member, the foot being attached to a pipe member which fits concentrically with another pipe member to which is attached the head or pushing end of the device. A lever arrangement connecting the two pipe members causes them to relatively displace when a lever handle is pushed toward the device. A head attachment, configured to the shape of the board to minimize damage, pushes against and straightens the crooked board for nailing. Limiting and adjusting means for displacement and leverage may be used. A cleated plate with cleat members protruding at approximately a forty-five degree angle from the foot may fix the foot on the board supporting member.

3 Claims, 4 Drawing Figures

BOARD STRAIGHTENING DEVICE

BACKGROUND OF THE INVENTION

1. Field of the Invention

The present invention generally relates to carpenters tools, and more particularly, is concerned with a device which is used to straighten boards which are being applied across joists, rafters or studs, or other board supporting members.

2. Description of the Prior Art

When carpenters apply boards, particularly tongue and groove siding or decking, across board supporting members, such as joists, rafters or studs, they almost universally are faced with the problem that some of the boards are bowed and bent, and therefore do not lie straight and parallel with the adjacent board. This condition is normally corrected by the use of a flat pry-bar or chisel to dig into the board supporting member and pry the offending board into a straight position for nailing. Such process may tear up both the boards being applied and the board supporting members to a considerable extent, and may require the help of another person.

U.S. Pat. No. 3,779,515, issued to D. Larios, et al, presents an adjustable decking and framing tool, one of whose functions is the pushing and pulling of deck boards into position for nailing. This device is designed for the movement of floor decking only. Due to its design, which involves the pivoting of a base member and of a lever arm about a single clevis pin, this device is not suitable for the pushing of vertical or overhead boards into position. Furthermore, the displacement of the device is severely limited and, when used in its pulling mode, severely gouges the already laid decking.

What is needed is a tool which can be used to straighten warped or bent boards, particularly pieces of siding or decking, so that they can be nailed into proper position across joists, rafters or studs, regardless of whether the application is below, as with decking, or vertical, as with siding, or overhead, as with vaulted or other ceilings.

The tool should not damage the crooked boards or previously applied boards, and should only have minimal damaging effect on the board supporting members. Since much siding and decking is constructed with tongue and groove lumber, the tool should be adaptable to such tongue and groove lumber in various sizes as well as to regular dimensional lumber.

Finally, the tool should be simple, yet sturdy.

SUMMARY OF THE INVENTION

The present invention provides a board straightening device designed to satisfy the aforementioned needs. The invention embodies a levered tool which serves to expand a concentric piping arrangement, one part of which is fixed on a joist, rafter, stud or other board supporting member, so that the offending non-straight board is forced into a straight configuration adjacent to the previously laid and nailed straight board.

Accordingly, the present invention involves a cleated foot for gripping the joist, rafter, stud or other board supporting member, the foot being attached to a pipe member which fits concentrically with another pipe member to which is attached the head or pushing end of the device. A lever arrangement connecting the two pipe members causes them to relatively displace when a lever handle is pushed towards the device. The foot being fixed on the board supporting member by the cleats, the head then pushes against the crooked board and forces it into a straight position for nailing. Limiting and adjusting means for displacement and leverage may be used. A variety of interchangeable tongue and groove attachments are available to connect to the head piece to permit damage-free straightening for tongue and groove lumber.

DESCRIPTION OF THE PREFERRED EMBODIMENT

Figures 1, 2, 3, 4:
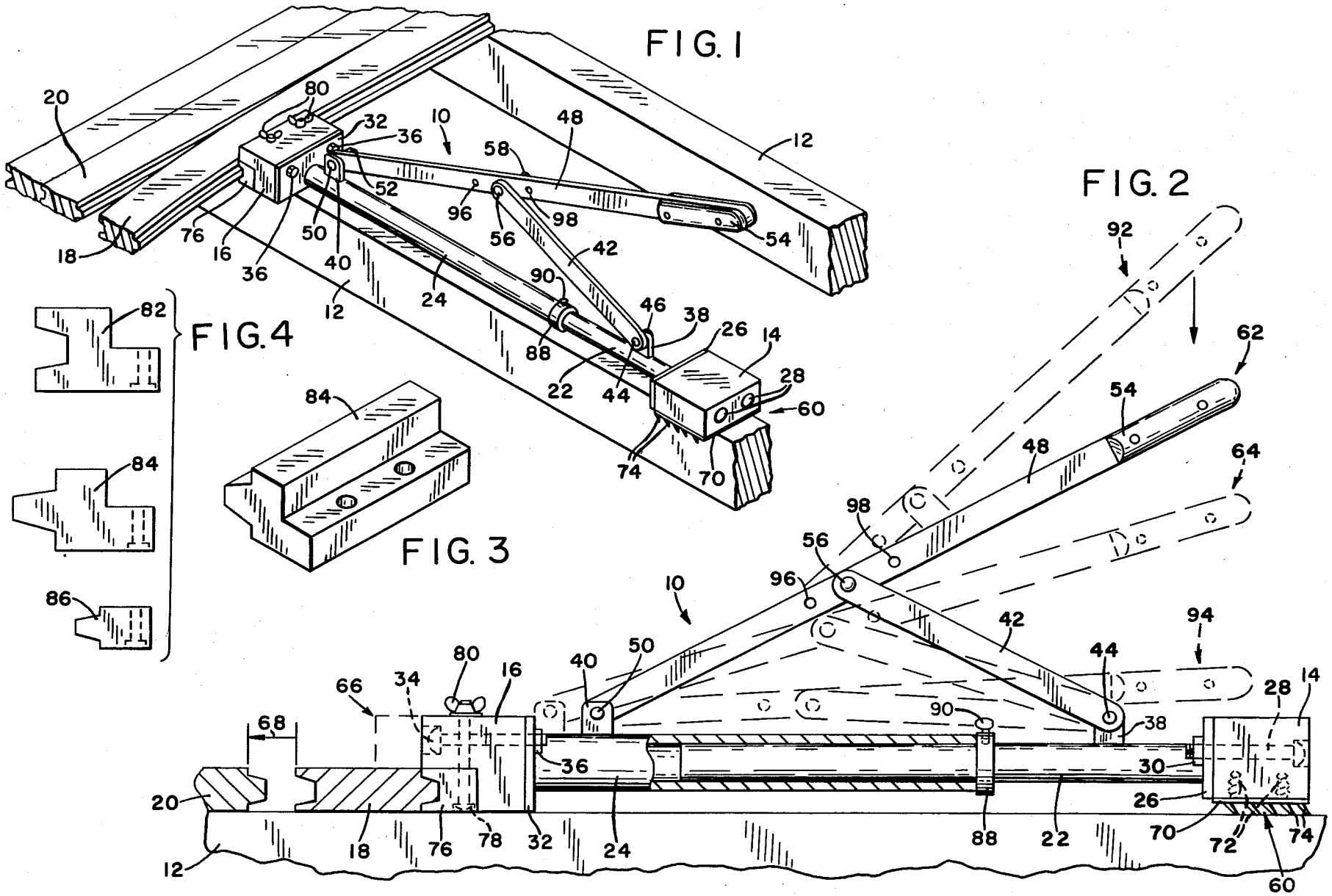
FIG. 1 shows the board straightening device in perspective, as used to push a crooked board into position for fastening to board supporting members.
FIG. 2 is a side view of the device of FIG. 1 in partial section.
FIG. 3 shows a removable head attachment in perspective.
FIG. 4 illustrates the head attachment of FIG. 3 and various other attachments for tongue and groove lumber in side view.

Referring now to the drawings, and particularly FIG. 1 and FIG. 2, the board straightening device 10 is shown as used. The board straightening device 10 is aligned along a board supporting member 12, such as a joist, rafter or stud, where the foot 14 of the device is anchored to the board supporting member 12, as described later, and the head 16 of the device with a head attachment appropriate to the crooked board 16 being pushed (head attachment 76 as illustrated in FIG. 1 and FIG. 2), aligned against the crooked board 18, so that movement of the handle 54 towards the device 10 will cause the device 10 to physically push the crooked board 18 into a straight configuration, aligned with the previously laid board 20, so that the crooked board 18 can be attached to the board supporting members 12 by nails or other means.

Looking more closely at the board straightening device 10 itself, the foot 14 is attached to a pipe member 22 which fits concentrically with a similar pipe member 24 that is attached to the head 16 of the device. In the preferred embodiment, the attachment of the the foot 14 to the foot pipe member 22 is achieved by the welding of an end plate 26 onto pipe member 22, and attaching the foot 14 to end plate 26 by means of two (2) carriage bolts 28 and their nuts 30. Similarly, the head pipe member 24 is welded to an end plate 32, which, in turn, is attached to the head piece 16 by carriage bolts 34 and their nuts 36. Other configurations of attachment of the pipe members 22 and 24 to the foot 14 and head 16 are within the scope of the invention, to include the fabrication of a single pipe and foot (or head) member by casting or otherwise.

The head pipe member 24 and the foot pipe member 22 fit concentrically, one within the other. As illustrated, the foot pipe member 22 fits within the head pipe member 24; the reverse is also possible, with no change in the operation of the device. Similarly, it should be noted that the inner member need not be a hollow pipe, but also could be a solid rod without a change in function.

Attached, by welding or otherwise, to the pipe members 22 and 24 on the top side thereof, in a position near to the respective end plates 26 and 32, are connecting tabs 38 and 40. The purpose of connecting tab 38 is to provide a point of pivotal connection between the short lever 42 and the foot pipe member 22. Connection between the short lever 42 and the foot pipe member 22 can be achieved by a bolt 44 and nut 46 combination through holes formed therein. Similarly connected on the top of the head pipe member 24, near end plate 32, is connecting tab 40 which provides a pivotal connecting point between the head pipe member 24 and the long lever 48. Bolt 50 and nut 52 are used to make this connection. Attached to the long lever 48 in an appropriate manner, or formed thereon, is a handle 54 against which manual pressure will be applied, the handle 54 serving to distribute pressure on the user's hand.

The long lever 48 and the short lever 42 are pivotally connected together by bolt 56 and nut 58, as illustrated. This connection between that end of the short lever 42 which is remote from the foot 14, and the approximate midpoint of the long lever 48 completes the lever arrangement necessary for the device.

When the handle 54 of the long lever 48 is pushed towards the foot 14 of the device, the foot 14 and the head 16 become more separated, the force against the handle 54 being translated along the lever combination both to press the device on the board supporting member 12 and to separate the foot 14 and head 16 thereof. Thus, as illustrated in FIG. 2, with the foot 14 fixed in a stationary position 60 on the board supporting member 12, when the handle 54 is moved from position 62 to position 64, the head 16 will be displaced forward, as shown at 66, and the crooked board 18 will be moved as shown at 68.

In order to achieve the desired movement of the head 16, so to cause the straightening of the crooked board 18, the foot 14 must provide a non-moving base. This is achieved by a cleat-type surface, located on the bottom of the foot 14. Preferably, the cleated surface is oriented away from the head 16 of the device at approximately a forty-five degree angle, so as to dig into the board supporting member 12 effectively when the handle 54 is pushed toward the board supporting member 12 and provide the necessary resistance to movement of the foot 14. Illustrated in FIG. 2 is a cleat plate 70, attached to the foot 14 by screws 72, wherein the cleat members 74 are so disposed. Various alternative cleating configurations are possible, to include screws penetrating the foot 14 from its top in an angular direction away from the head 16 of the device, so that their sharp points project below the foot for a short distance, e.g. one-fourth inch (not shown).

The head 16 itself, as previously described, is not intended to push directly against the offending crooked board 18. Rather the head 16 is designed to accept various head attachments which are shaped to impart minimum damage to the crooked board 18 during the straightening operation. Such attachment can best be seen in FIG. 1 and FIG. 2, wherein the head attachment 76, shaped on its forward face with a recess to accomodate the "tongue" surface of the tongue and groove lumber against which it is pushing, is connected to the head 16 by two (2) carriage bolts 78 and accompanying wingnuts 80, wingnuts being used for easy removal and replacement. Since it is anticipated that the straightening of tongue and groove formed siding and decking will be a major function of this tool, various configurations of head attachments 82, 84, and 86 are shown in FIG. 4 in side view to illustrate both smaller and larger sizes of tongue and of groove accomodation. FIG. 3 illustrates, in perspective, a larger-groove-accomodating head attachment 84, formed so as to connect with head 16. FIG. 1 and FIG. 2, as noted previously, show head attachment 76 in use, as attached to the head 16. Other head attachment configurations, which match up with the board being pushed so as to cause minimum damage in the straightening operation are within the scope of this invention; included in this group are heads with flat pushing surfaces, to be used against conventional square cut boards (not shown).

Two additional features are available in the preferred embodiment. As will be apparent to the person skilled in the use of levers, greater leverage can be achieved in the configuration of this invention when force is applied to the the handle 54 when it is in a lower position near the remainder of the device 10. Since the present invention has the advantage of being able to be used on vertical walls and overhead ceilings as well as floors to straighten crooked boards prior to attachment to board supporting members, it has been recognized that in some physical positions the user may only be able to apply limited force to the device. It therefore is desirable to limit the distance that the handle 54 can travel away from the device 10, and so restrict handle movement to that range wherein sufficient leverage can be applied to operate the device effectively. This is accomplished by a collar 88, of similar diameter as the outer piping (head pipe member 24 as illustrated) which is located slideably along the inner piping (foot pipe member 22 as illustrated). A winged thumb screw 90, is provided to lock the collar in any set position desired. The further from the foot 14 that the collar 88 is locked on the foot pipe member 22, the more limited is the height to which the handle 54 can be raised. Thus, with the collar 88 located as illustrated in FIG. 2, the handle 54 is at its highest position 62. With the collar 88 loose or locked close to connecting tab 38, the handle could achieve position 90. (The lowest position 92 of the handle 54 is limited by the handle 54, or the user's hand encircling it, coming against the remainder of the the device 10 itself.) The trade-off in limiting the range of handle movement, as will be readily recognized, is a reduction in the available displacement of the head 16. The advantage of the limitation made possible by collar 88 becomes especially important in overhead work with the device, where it is difficult to apply force to the handle 54 because of the working angles involved.

Similarly, it also is found advantageous to provide adjustability in leverage versus displacement in the the device generally. This is accomplished by the forming of additional connection points 96 and 98 along the long lever 48. Pivotally connecting the end of the short lever 42 at the connecting point 96 serves to decrease possible displacement while limiting the movement of the handle 54 for increased leverage application; while a connection at connecting point 98 has the opposite effect, that is, to increase displacement but permit handle 54 to go to a position where more pressure is required for displacement. Connecting points 96 and 98 are, of course, illustrative; other connecting points can be established to achieve greater adjustability in the use of the device.

In the preferred embodiment illustrated above, the device 10 is operated by the movement of the handle 54 generally towards the foot 14. While this configuration is preferred, the head 16 and foot 14 could be interchanged so that the handle would approach the head 16 in use. Operation of the device 10 remains the same, only the operating position of the user would change, at his preference.

It is thought that the board straightening device of the present invention and its many attendant advantages will be understood from the foregoing description and that it will be apparent that various changes may be made in form, construction and arrangement of the parts thereof without departing from the spirit and scope of the invention or sacrificing all of its material advantages, the form hereinbefore described being merely an exemplary embodiment thereof.

I claim:

1. A device for the straightening of boards, to include siding, decking, and overhead boards being attached in parallel to joists, studs, rafters or other supporting members, which comprises:

(a) a head member to physically contact and push against a crooked board so as to straighten it prior to final attachment to joists, studs, rafters or other supporting members; the said head member comprising both a head and a head attachment, the said head accepting for connection thereto various individual head attachments, said head attachments including configurations to match straight boards, larger tongue and groove boards, and smaller tongue and groove boards, so that various sizes and types of boards, particularly tongue and groove boards, can be straightened with minimum physical damage to the board themselves.

(b) a foot member, which includes means for fixing the said foot member on a supporting board, such as a joist, stud, rafter; the said foot member including a cleated surface.

(c) means for increasing the distance between the said head member and said foot member, wherein the said increase in distance, with the said foot member being fixed in position, will press the said head member against a crooked board to straighten it prior to its final attachment in place; the said means for increasing the distance between the said head member and the said foot member including:

a tubular member attached to the said head member and a tubular member attached to the said foot member, the two (2) tubular members being so designed that one said tubular member will fit and move concentrically within the other said tubular member, the inside radius of the outer tubular member being slightly greater than the outside radius of the inner tubular member, the said inner tubular member being either solid or hollow in form;

a shorter lever arm, attached pivotally at one end to one said tubular member near that tubular member's said attached foot or head member;

a longer lever arm, attached pivotally at one end to the other said tubular member near that tubular member's said attached head or foot member;

wherein the said shorter lever arm has its other end attached pivotally to the said longer lever arm at a position near the approximate center of the longer lever arm, so that force exerted on the free end of the longer lever generally toward the device will provide causation, through the lever arrangement with the said foot member fixed in place, for the said head member to displace away from the said fixed foot member;

the said pivotal point of attachment of the said shorter lever arm to the said longer lever arm being made variable by the provision of a multiple number of pivotal attachment points on the said longer lever arm, so that the leverage obtained from the device and the resulting displacement of the head can be varied as desired by the user; and, a collar placed about the said inner tubular member, said collar being capable of being fixed at any location on said inner tubular member, so as to restrict the concentric movement of the outer tubular member thereupon, said restriction serving to the reduce the potential displacement and to limit the lever movement to within that range where the greater leverage is available.

2. The board straightening device, as recited in claim 1, wherein the said cleated surface comprises a cleated plate affixed to the said foot member, whose individual protruding cleat members are slanted at an angle of approximately forty-five (45) degrees in the direction away from the said head member of the device.

3. A device for the straightening of boards, to include siding, decking, and overhead boards being attached in parallel to joists, studs, rafters or other supporting members, which comprises:

(a) a head member to physically contact and push against a crooked board so as to straighten it prior to final attachment to joists, studs, rafters or other supporting members;

(b) a foot member, which includes means for fixing the said foot member on a joist, stud, rafter or other supporting member;

(c) means for increasing the distance between the said head member and said foot member, wherein the said increase in distance, with the said foot member being fixed in position, will press the said head member against a crooked board to straighten it prior to its final attachment in place; the said means for increasing the distance between the said head member and the said foot member including:

a tubular member attached to the said head member and a tubular member attached to the said foot member, the two tubular members being so designed that one said tubular member will fit and move concentrically within the other said tubular member, the inside radius of the outer tubular member being slightly greater than the outside radius of the inner tubular member, the said inner tubular member being either solid or hollow in form;

a shorter lever arm, attached pivotally at one end to one said tubular member near that tubular member's said attached foot or head member;

a longer lever arm, attached pivotally at one end to the other said tubular member near that tubular member's said attached head or foot member;

wherein the said shorter lever arm has its other end attached pivotally to the said longer lever arm at a position near the approximate center of the longer lever arm, so that force exerted on the free end of the longer lever generally toward the device will provide causation, through the lever arrangement with the said foot member fixed in place, for the said head member to displace away from the said fixed foot member; and a collar placed about the said inner tubular member, said collar being capable of being fixed at any location on said inner tubular member, so as to restrict the concentric movement of the outer tubular member thereupon, said restriction serving to reduce the potential displacement and to limit the lever movement to within that range where the greater leverage is available.

* * * * *